United States Patent [19]

Jones

[11] Patent Number: 4,955,155

[45] Date of Patent: Sep. 11, 1990

[54] PIVOTING TRIGGER GROUP ASSEMBLY

[76] Inventor: Benton L. Jones, 2102 24th St. SE., Ruskin, Fla. 33570

[21] Appl. No.: 339,510

[22] Filed: Jun. 1, 1989

[51] Int. Cl.[5] ..... F41A 19/10

[52] U.S. Cl. ..... 42/69.01

[58] Field of Search ..... 42/69.01, 69.02, 69.03

[56] References Cited

U.S. PATENT DOCUMENTS 1,285,954 11/1918 Diehm .
1,344,884 6/1920 Guyot .
1,712,411 5/1929 Walther .
1,909,425 5/1933 Reid .
2,138,213 11/1938 Seidel .
2,139,203 12/1938 Petter .
2,535,156 12/1950 Pastore et al. .
2,846,925 8/1958 Norman .
4,275,640 6/1981 Wilhelm .
4,691,461 9/1987 Behlert .
4,706,401 11/1987 Nielsen .

*Primary Examiner*—Charles T. Jordan
*Assistant Examiner*—Richard W. Wendtland

[57] ABSTRACT

A semi-sutomatic Colt 1911 pistol's conventional trigger mechanism is replaced with a lever system comprised essentially of a trigger, a trigger support shoe, and a stirrup which system requires minimal force and trigger travel to fire the pistol.

1 Claim, 2 Drawing Sheets

PIVOTING TRIGGER GROUP ASSEMBLY

BACKGROUND OF THE INVENTION

In a Colt 1911 semi-automatic handgun, a trigger is provided with a related mechanism which when activated releases a spring loaded hammer. The hammer is allowed to fall and strike the firing pin which, in turn detonates the cartridge in the chamber of the handgun. Due to the high degree of friction which exists between the string-loaded parts in the Colt 1911 pistol, the straight pull back trigger requires a relatively strong force and long travel to function the pistol. Since the trigger pull is of considerable importance in target shooting, the conventional seven-pound pull of the Colt 1911 is unsatisfactory for a marksman to achieve the desired accuracy from the Colt 1911. It is desirable to have a trigger pull which functions the pistol satisfactorily and safely, closer to one or two-pounds of pull. Prior art examples of firearms similar to the Colt 1911 modified with pivoting trigger group assemblies have been limited to complicated mechanisms mounted outside the trigger guard utilizing a series of primary and secondary triggers camming against each other for relatively light but long trigger pull. An example is disclosed in U.S. Pat. No. 1,909,425 to Reid. Or trigger mechanisms internal to the trigger guard but requiring complicated machining and modification of the pistol frame. The pistol frame is the foundation to which all the other parts are assemblied. The machining of a pistol frame and the possible undermining of its foundation may lead to premature breakage, and prevents the pistol from being returned to its conventional trigger configuration. A recent example is disclosed in the U.S. Pat. No. 4,691,461 to Behlert.

FIELD OF THE INVENTION

This invention relates to firearms, in particular to trigger mechanisms used in Colt 1911, and Colt 1911 Al semi-automatic pistols, copies and other similar pistols.

SUMMARY OF THE INVENTION

The object of the present invention is to overcome the deficiencies of previous trigger mechanisms employed in the Colt 1911 pistol. This objective is achieved with an innovative pivoting trigger group assembly which replaces the straight pull back trigger of the Colt 1911 pistol. The Pivoting Trigger Group Assembly fits completely within the trigger guard and requires no modification of the original frame other than drilling and tapping one hole on the underside of the trigger guard. Installation Of a single set screw in the before mentioned hole locks the trigger assembly securely in the pistol frame. This proceedure can be accomplished quickly and easily using common hand tools.

The Pivoting Trigger Group Assembly increases the leverage over the original Colt 1911 trigger, for a lighter, shorter, and safer trigger pull. Unlike before mentioned pivoting triggers, the Pivoting Trigger Group Assembly does not utilize a primary and a secondary trigger to achieve its leverage advantage. While this is an effective means of reducing the force necessary to activate the hammer releasing mechanism, the complicated linkeage between the two triggers makes for a relatively long trigger pull, which is very similair to double action trigger pull of most revolvers. Not only does prolonged movement of the trigger affect the accuracy of the pistol, it lengthens the recycle time; this is the time it takes to pull the trigger and then release so the trigger can return and set for the next trigger pull. What is most desirable in a target pistol is a light trigger with a short trigger pull. The Pivoting Trigger Group Assembly accomplishes this by incorporating a single pivoting trigger and a trigger actuator stirup. The mechanical linkage of these two parts makes for a lever system with a high exchange ratio between the trigger and the releasing parts of the hammer. This means that only a small amount of trigger travel is necessary to release the hammer.

With the ease of installation, the advantages of a pivoting trigger will now be affordable to the Colt 1911 owner without compromising the structural integrity of the pistol frame.

DETAILED DESCRIPTION OF THE INVENTION

Figure 1:
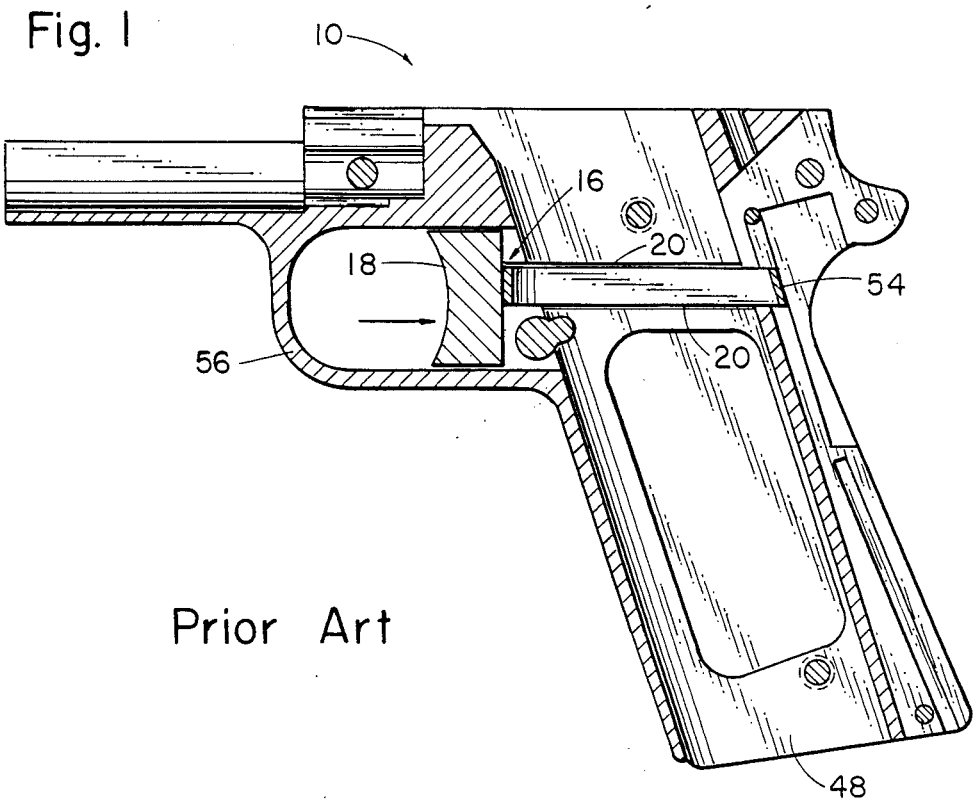
FIG. 1. Is a sectional view of a Colt 1911 with it's conventional trigger.

For the purposes of comparison FIG. 1 shows a left side sectional view of the colt 1911 with it's conventional slide trigger. The Colt 1911 semi-automatic pistol utilizes a spring loaded hammer. Due to the high degree of friction which exists between the spring-loaded parts in the Colt 1911 pistol, the straight pull back trigger 1 requires that a relatively strong force be applied to the front surface 2 of the trigger and a long rearward travel along the rails of frame 3 to actuate the other related hammer releasing parts which come in contact with the rear surface 4 of the trigger.

Figure 2:
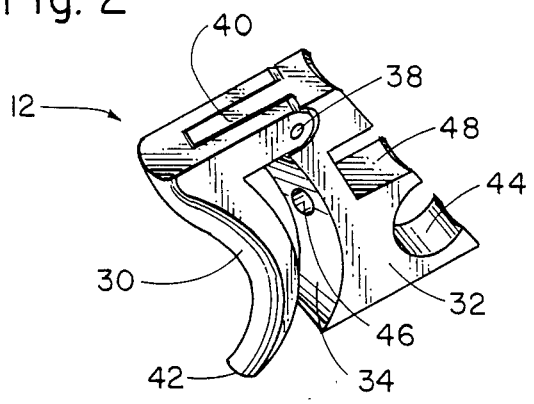
FIG. 2. Is a perspective view of the Pivoting Trigger and Trigger Support Shoe of the present invention.

FIG. 2 shows a perspective view of the Pivoting Trigger 1 and the Trigger Support Shoe 2 of the present invention. The Trigger Support Shoe is the foundation of the Pivoting Trigger Group Assembly, Filling the space previously occupied by the conventional trigger, with it's front contour 3 matching the contour of the pistol frame with one set screw locking it securely in place. The Trigger Support Shoe and the Pivoting Trigger are constructed like a hinge 4 with pin 5 providing the pivot point of the trigger. With the Trigger Support Shoe locked into the frame of the pistol, the Pivoting Trigger is allowed to swing free. Rearward travel is adjusted by removing metal from the bottom edge 6 of the trigger. Hole 7 in the Trigger Support Shoe allows passage for the pistol's magazine release button. Hole 8 and slot 9 in the Trigger Support Shoe are alignment guides for the Trigger Actuator Stirup 1 in FIG. 3.

Figure 3:
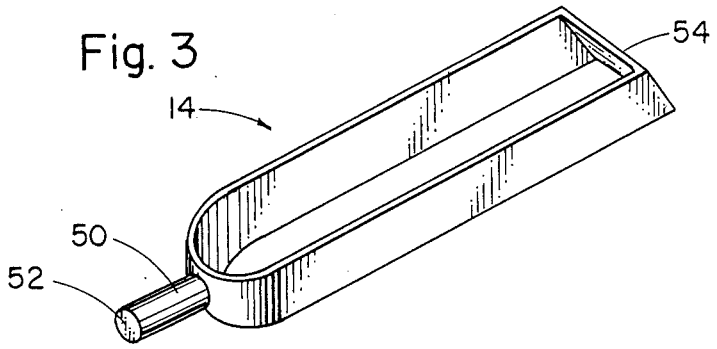
FIG. 3. Is a perspective view of the Trigger Actuator Stirup of the present invention.

FIG. 3 shows a perspective view of the Trigger Actuator Stirup 1 of the present invention. The Trigger Actuator Stirup Slides back and forth in the trigger slide rails of the frame previously occupied by the conventional trigger. The trigger actuator is constructed like a stirup allowing passage of the pistol's magazine in the pistol's magazine well. In front of the Trigger Actuator Stirup is a pin 2 which aligns with hole 8 of FIG. 2. The back of the Pivoting Trigger and front 3 and rear 4 of the Trigger Actuator Stirup are constructed at precise angles. When rearward force is applied to the Pivoting Trigger the back of the trigger comes in contact with the front of the Trigger Actuator Stirup, the two angled surfaces cam against each other sliding the Trigger Actuator stirup rearward. The rear angled surface of the Trigger Actuator Stirup contacts the hammer releasing mechanism, activating the hammer. This construction constitutes a lever system with a high exchange ratio between the trigger and the releasing mechanism of the hammer. This means that only a small amount of force rearward on the trigger with a minimal amount of travel is required to release the hammer.

Figure 4:
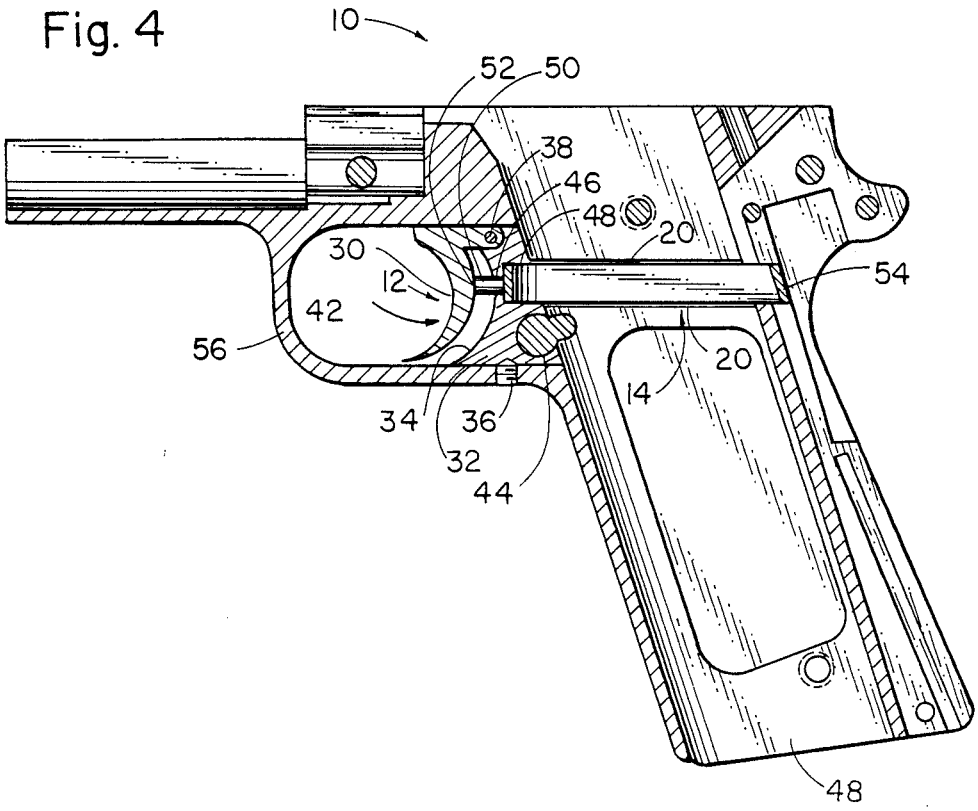
Prior Art Fig. 4
FIG. 4. Is a sectional view of a Colt 1911 showing the location of the Pivoting Trigger Group Assembly.

FIG. 4 is a left side sectional view of the Colt 1911 showing the location of each part of the present invention. Pivoting Trigger 1 is hinged to Trigger Support Shoe 2 by pin 3 and held securely in place by set screw 5 without any modification of the pistol frame. The Trigger Actuator Stirup 4 slides back and forth in the trigger slide rails of the pistol.

Comparing FIGS. 1 and 4, the location of the Pivoting Trigger is the same as the conventional trigger of the Colt 1911. The Pivoting Trigger Group Assembly is housed completely within the trigger guard of the pistol.

It should be understood that the above descriptions of the present invention are for the purposes of illustration only. There may be other modifications and changes obvious to those skilled in the art of Colt 1911 trigger modification which fall within the scope of the present invention which should be limited only by the following claims and their legal equivalents.

What is claimed is:

1. In a semi-automatic pistol having a frame, trigger frame rails, and a spring-loaded hammer, a trigger mechanism comprising a lever system including:

(1) a trigger, (2) a pin, (3) a support shoe, (4) a set screw, and (5) a stirrup, wherein said trigger being hingedly secured to said support shoe by said pin, said support shoe being securely fastened within said frame of said pistol by said set screw, said stirrup slidingly located within said trigger frame rails, said trigger contacting said stirrup to produce a camming action resulting in a mechanical advantage requiring minimal force and trigger travel to actuate said hammer.

* * * * *